US007247187B2

(12) United States Patent
Ramstedt et al.

(10) Patent No.: US 7,247,187 B2
(45) Date of Patent: Jul. 24, 2007

(54) METAL POWDER COMPOSITION INCLUDING A BONDING BINDER/LUBRICANT

(75) Inventors: Maria Ramstedt, Helsingborg (SE); Per Knutsson, Ängelholm (SE)

(73) Assignee: Höganäs AB, Höganäs (SE)

( * ) Notice: Subject to any disclaimer, the term of this patent is extended or adjusted under 35 U.S.C. 154(b) by 0 days.

(21) Appl. No.: 10/515,374

(22) PCT Filed: Jun. 12, 2003

(86) PCT No.: PCT/SE03/00989

§ 371 (c)(1),
(2), (4) Date: Nov. 23, 2004

(87) PCT Pub. No.: WO03/106078

PCT Pub. Date: Dec. 24, 2003

(65) Prior Publication Data

US 2005/0247163 A1 Nov. 10, 2005

(30) Foreign Application Priority Data

Jun. 14, 2002 (SE) ..... 0201826

(51) Int. Cl.
*B22F 1/00* (2006.01)

(52) U.S. Cl. ..... 75/252

(58) Field of Classification Search ..... 75/252
See application file for complete search history.

(56) References Cited

U.S. PATENT DOCUMENTS 4,544,694 A * 10/1985 Bower ..... 524/385
4,834,800 A 5/1989 Semel
5,432,223 A 7/1995 Champagne et al.
5,480,469 A 1/1996 Storstrom et al.
5,518,639 A 5/1996 Luk et al.
5,525,293 A 6/1996 Kagawa et al.
5,538,684 A 7/1996 Luk et al.
5,641,920 A 6/1997 Hens et al.
5,678,165 A 10/1997 Wu
5,688,591 A 11/1997 Kuwajima et al.
6,187,259 B1 2/2001 Yamashita et al.
6,447,571 B1 9/2002 Ito et al.
6,679,935 B2 * 1/2004 Hammond ..... 75/252

FOREIGN PATENT DOCUMENTS

WO WO 01/17716 3/2001
WO WO 03/015962 2/2003

OTHER PUBLICATIONS

Randall M. German, "Thermal Extraction of Binders and Lubricants in Sintering", Brush Chair Professor in Materials, P/M Lab, 118 Research West, Engineering Science and Mechanics Department, The Pennsylvania State University, University Park, PA, pp. 10-3 to 10-16 (1996).

* cited by examiner

*Primary Examiner*—Roy King
*Assistant Examiner*—Ngoclan T. Mai
(74) *Attorney, Agent, or Firm*—Buchanan Ingersoll & Rooney PC

(57) ABSTRACT

The present invention concerns a metal powder composition for the powder metal industry, wherein the metal powder is selected from the group consisting of an atomized iron-based powder or a sponge iron powder, and a lubricant composition comprising glyceryl stearate.

17 Claims, 2 Drawing Sheets

METAL POWDER COMPOSITION INCLUDING A BONDING BINDER/LUBRICANT

FIELD OF THE INVENTION

The present invention relates to a metal powder composition for the powder metal industry. Particularly the invention relates to an iron-based metal powder composition comprising glyceryl stearate.

BACKGROUND OF THE INVENTION

In industry the use of metal products manufactured by compacting and sintering iron-based powder compositions is becoming increasingly widespread. A number of different products of varying shapes and thickness are being produced. One processing technique for manufacture the products from the base powders is to charge the powder into a die cavity and compact the powder under high pressures. The obtained compact is then removed from the die cavity and sintered.

The quality requirements of the products are continuously raised, and in this context one important factor is that the manufactured products have high and consistent density. Much effort is put into research to develop such products and one field within this research concerns lubrication, which is used i.a. to avoid excessive wear on the die cavity during compaction. Lubrication is accomplished by spraying a liquid dispersion or solution of the lubricant onto the die cavity surface (external lubrication) or by blending a solid lubricant powder with the iron-based powder (internal lubrication). In some cases, both lubrication techniques are utilized.

The use of external, die wall lubricants can reduce or eliminate the need for an internal lubricant, but problems accompany external lubrication techniques. First, the film thickness within the die cavity has a tendency to vary, and the lubricant dispersion is known to drip out of the die cavity during processing. Also, aqueous dispersions are a source of rust formation on the die cavity. Another problem is that various external lubricant compositions are not necessarily sufficient to adequately lower ejection forces, especially at higher compaction pressures. Finally, as a technique, the die wall lubrication does not permit high productivity in comparison with internal lubrication.

Lubrication by means of blending a solid lubricant into the iron-based powder composition has also disadvantages. One problem is that the lubricant generally has a density of about 1-1.2 g/cm$^3$, as compared with the density of the iron-based powder, which is about 7-8 g/cm$^3$. Inclusion of the less dense lubricant in the composition lowers the green density of the compacted part. Second, internal lubricants are generally not sufficiently effective for reducing the ejection pressures when manufacturing parts having part heights in excess of about 2.5-5 cm. Another problem is, when the particles of internal lubricant burn off during sintering, pore spaces can be left in the compacted part, providing a source of weakness for the part. Many presently used lubricants also have the disadvantage of requiring high energies for ejecting the green compact from the die.

Another disadvantage with presently used lubricants is that they often include zinc stearate. This is due to the fact zinc stearate imparts good flow properties to metal powder compositions including this stearate. In reducing atmospheres, the zinc oxide remaining after initial decomposition of the stearate is reduced to zinc, which readily volatilises because of its low boiling point. Unfortunately, on contacting the cooler parts of the furnace or the outside atmosphere, the zinc tends to condense or reoxidise. A consequence of reactions is that the production has to be interrupted as the furnace has to be cleaned regularly.

The problems associated with zinc stearate can be avoided by the use of completely organic materials such as waxes. The wax most widely used in powder metallurgy is ethylene-bisstearamide, EBS, (available under the name Acrawax™ C or Licowax™). This material has a high melting point (140° C.) but it burns off at relatively low temperatures and leaves no metallic residue. The most serious disadvantage is its poor flow behaviour in metal powders.

The present invention is particularly directed to iron based compositions with internal lubrication and wherein the lubrication is provided by a new lubricant composition including glyceryl stearate.

An additional field of application of the glyceryl stearate compositions or mixtures according to the present invention is as binders for pulverulent additives to the metal powder which makes it possible to produce non dusting powder mixtures that are also free from segregation.

Glyceryl stearate has been mentioned in connection with iron-based metal powders for the PM-industry in U.S. Pat. No. 5,518,639 and the related U.S. Pat. No. 5,538,684 which discloses lubricant compositions containing a solid phase lubricant, such as graphite, molybdenum disulfide, and polytetrafluoroethylene in combination with a liquid phase lubricant that is a binder for the solid phase lubricant. The binder can be chosen from various classes of compounds including polyethylene glycols, polyethylene glycol esters, partial esters of $C_{3-6}$ polyhydric alcohols, polyvinyl esters, and polyvinyl pyrrolidones. The binder is solubilized in an organic solvent. This lubricant composition is applied to the surface of a die cavity prior to compaction of the metal powder composition. The glyceryl stearate is thus known use as a binder in connection with external lubrication and, in contrast to the lubricant according to the present invention, it is not mixed with the iron-based powder and optional additives before the compaction.

Furthermore, the U.S. Pat. No. 5,432,223 discloses that glyceryl stearate can be used as a plastiziser in polyvinylpyrrolidone, which is a binding agent which may be used in metal powder compositions.

Another patent which mentions glyceryl stearate in connection with metal powders is the U.S. Pat. No. 6,187,259. In this patent glyceryl stearate is mentioned together with a wide variety of other substances as an agent for providing hydrofobicity in rare earth alloy powders for the production of granules.

The U.S. Pat. No. 5,641,920 mentions the use of glyceryl monostearate as a plasticizer/compatibilizer in powders for injection moulding. In an article "Thermal extraction of binders and lubricants in sintering" by German in Advances in Powder Metallurgy & Particulate Materials, 1996 glyceryl monostearate is also mentioned.

In the recently published WO 03/015962 glycerol monostearate is mentioned in lubricant systems in combination with different guanidine compounds. The systems actually tested in combination with metal powders do however not include glyceryl stearate. No beneficial effects with guanidine compounds have been observed in connection with the present invention, a reason why such guanidine compounds are not included in the lubricant/binder system according to the present invention.

OBJECTS OF THE INVENTION

An object of the invention is to provide an iron-based powder metal composition comprising a lubricant resulting in compacts with high and consistent densities.

A second object of the invention is to provide an iron-based powder metal composition comprising a lubricant resulting in compacts requiring low ejection energies.

A third object of the invention is to provide an iron-based powder metal composition having good flow and comprising a lubricant which is free of zinc.

A fourth object of the invention is to provide an iron-based powder metal composition, which is essentially free from dusting and segregation and wherein the glyceryl stearate acts as a binder.

SUMMARY OF THE INVENTION

These objects as well as other objects that will be apparent from the description below have now been obtained according to the present invention by providing a metal powder composition comprising a lubricant and/or binder system comprising glyceryl stearate.

DETAILED DESCRIPTION OF THE INVENTION

Figure 1:
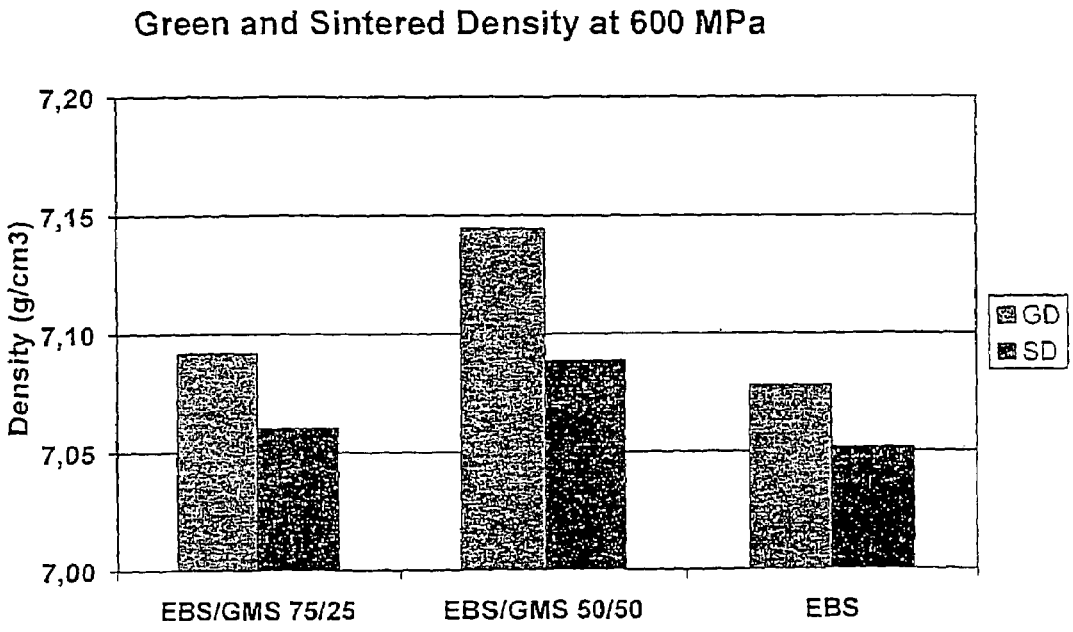
FIG. 1 discloses the green and sintered densities obtained with the inventive powder composition including glyceryl stearate in comparison with the same powder including the conventionally used lubricant EBS.

As used in the description and the appended claims, the expression "iron-based powder" encompasses powders prepared by atomisation, preferably water atomisation. Alternatively, the powder may be based on sponge iron. The powders may be made up essentially of pure iron; iron powder that has been pre-alloyed with other substances improving the strength, the hardening properties, the electromagnetic properties or other desirable properties of the end products; and particles of iron mixed with particles of such alloying elements (diffusion annealed mixture or purely mechanical mixture). Examples of alloying elements are copper, molybdenum, chromium, nickel, manganese, phosphorus, carbon in the form of graphite, and tungsten, which are used either separately or in combination, e.g. in the form of compounds ($Fe_3P$ and FeMo). Unexpectedly good results are obtained when the lubricants according to the invention are used in combination with iron-based powders having high compressibility. Generally, such powders have a low carbon content, preferably below 0.04% by weight. Such powders include e.g. Distaloy AE, Astaloy Mo and ASC 100.29, all of which are commercially available from Höganäs AB, Sweden. The particles of iron based powders will have a weight average particle size in the range of above about 10 microns. Preferred are iron or pre-alloyed iron particles having a maximum weight average particle size up to about 350 microns; more preferably the particles will have a weight average particle size in the range of about 25-150 microns, and most preferably 40-100 microns.

A key feature of the present invention is the glyceryl stearate lubricant. Three forms of glyceryl stearate exist, namely mono-, di- or tristearate. Technical grade glyceryl monostearate which includes about 20% glyceryl distearate is used in a preferred embodiment of the invention.

It is preferred that the glyceryl stearate is used in combination with at least one additional lubricant/binder, which is preferably selected from the group consisting of non-metallic fatty acid compounds, such as ethylene bisstearamide, stearic acid, oleic acid, oleyl amide, stearamide and ethylene bisoleylamide and/or metal salts of fatty acids, such as zinc stearate, calcium stearate and lithium stearate. According to a preferred embodiment of the invention the lubricant/binder is made up by 5-95% by weight of the glyceryl stearate and 95-5% by weight of the additional lubricant/binder. The presently most preferred embodiment of the lubricant/binder is a composition comprising 5-95% by weight of the glyceryl stearate and 95-5% by weight of ethylene bisstearamide. Most preferably the lubricant/binder according to the present invention includes 15-40% by weight of glyceryl stearate and 85-60% by weight of ethylene bisstearamide. If more than 95% by weight of glyceryl stearate is used, inferior powder properties are obtained and the surfaces of the compacted parts will become sticky. One aspect of the invention concerns such a lubricant composition per se.

The total amount of the glyceryl stearate containing lubricant/binder in the metal powder composition may vary between 0.1 and 2.0% by weight, preferably between 0.1 and 0.8% by weight.

The lubricant composition may be used as a physical mixture, but is most preferably used as a molten and subsequently solidified and micronised powder of solid particles. The average particle size of the lubricant particles may vary, but is preferably in the range of 3-150 μm. If the particle size is too large, it becomes difficult for the lubricant to leave the pore structure of the metal-powder composition during compaction and the lubricant may then give rise to large pores after sintering, resulting in a compact showing impaired strength properties.

When the glyceryl stearate mixture according to the invention is used as a binder, the method of preparation of the metal powder mixture to be compacted may be performed as described in the U.S. Pat. No. 5,480,469 or in the WO publication 01/17716 both of which are hereby incorporated by reference. As described herein the binder efficiently exerts its binding effect when present in molten and, subsequently, solidified form, i.e. the homogeneous powder mixture is contacted with the binder in the molten state thereof, whereupon the binder is allowed to solidify. According to our observations it has been found that it is not necessary to melt the whole lubricant/binder composition according to the present invention but that a partial melting is sufficient.

Apart from the iron-based powder and the lubricant/binder according to the invention, the metal powder composition may contain one or more additives selected from the group consisting of binders, processing aids, hard phases and flow enhancing agents. The binder may be added to the powder composition in accordance with the method described in U.S. Pat. No. 4,834,800 (which is hereby incorporated by reference).

The binder used in the metal-powder composition may consist of e.g. cellulose ester resins, hydroxyalkyl cellulose resins having 1-4 carbon atoms in the alkyl group, or thermoplastic phenolic resins.

The processing aids used in the metal-powder composition may consist of talc, forsterite, manganese sulphide, sulphur, molybdenum disulphide, boron nitride, tellurium, selenium, barium difluoride and calcium difluoride, which are used either separately or in combination.

The hard phases used in the metal-powder composition may consist of carbides of tungsten, vanadium, titanium, niobium, chromium, molybdenum, tantalum and zirconium, nitrides of aluminium, titanium, vanadium, molybdenum and chromium, $Al_2O_3$, $B_4C$, and various ceramic materials.

The flow enhancing agent may e.g. be nano-particles of silicon dioxide or other substances of the type disclosed in the U.S. Pat. No. 5,782,954 which is hereby incorporated by reference.

In brief a powder compositions which is especially preferred according to the invention is a metal powder composition including a metal base powder; one or more pulverulent additives, wherein the particles of at least one of the additives are bonded to the metal base powder particles by an at least partially molten solidified mixture consisting of 5-95% by weight of the glyceryl stearate and 95-5% by weight of at least one lubricant selected from the group consisting of non-metallic fatty acid compounds and a metal salts of fatty acids.

Another embodiment of the invention concerns a metal powder composition including a metal base powder, optionally one or more pulverulent additives and 0.1-2.0% by weight of a pulverulent lubricant composition including mixture consisting of 5-95% by weight of the glyceryl stearate and 95-5% by weight of at least one lubricant selected from the group consisting of non-metallic fatty acid compounds and a metal salts of fatty acids.

With the aid of conventional techniques, the iron-based powder and the lubricant particles are mixed to a substantially homogeneous powder composition.

EXAMPLE

The following example, which is not intended to be limiting, present certain embodiments and advantages of the present invention. Unless otherwise indicated any percentages are on a weight basis.

The mixtures listed in table 1 below were prepared:

TABLE 1

| Sample | GMS* | EBS** |
|---|---|---|
| 1 | 0 | 100 |
| 2 | 25 | 75 |
| 3 | 50 | 50 |

*Glyceryl monostearate
**Etylene bisstearamide

The iron-based powder in all samples was ASC100.29 which is a water atomised, high purity iron powder available from Höganäs AB, Sweden. The total amount of lubricant was 0.8% which was admixed in the powder composition together with 0.5% graphite(C-uf4). The dry ingredients in the different test mixtures i.e. the iron powder, the lubricant and the graphite were blended to homogenous mixtures and added to a die cavity before compaction. The compaction operation was performed with the different powder mixtures at 400, 600 and 800 MPa at ambient temperature.

Figure 2:
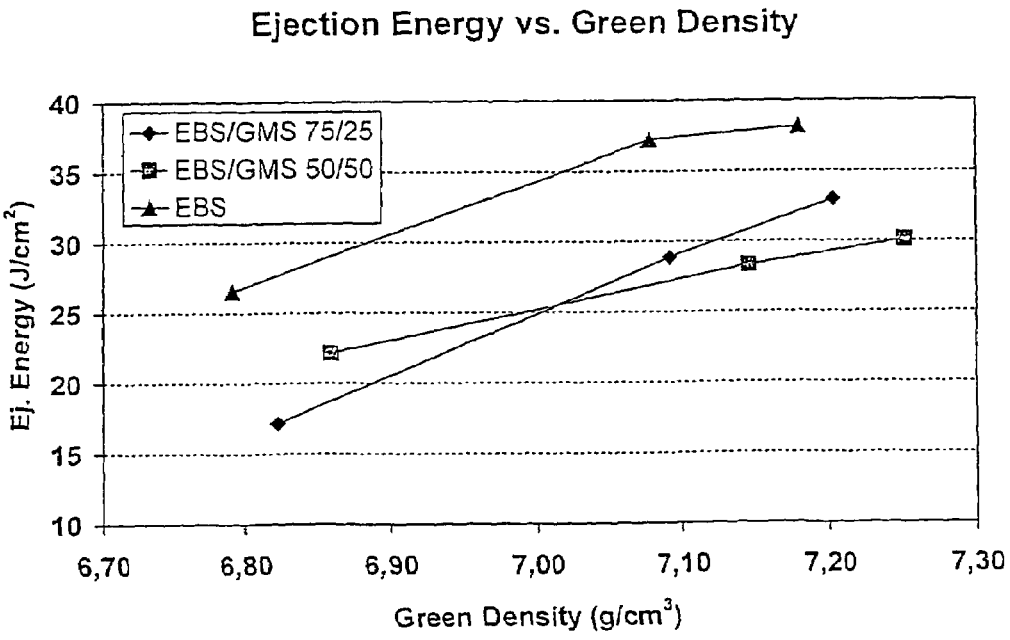
FIG. 2 discloses the ejection energy as a function of the green density obtained with the inventive powder composition in comparison with the same powder including the conventionally used lubricant EBS.
Figure 3:
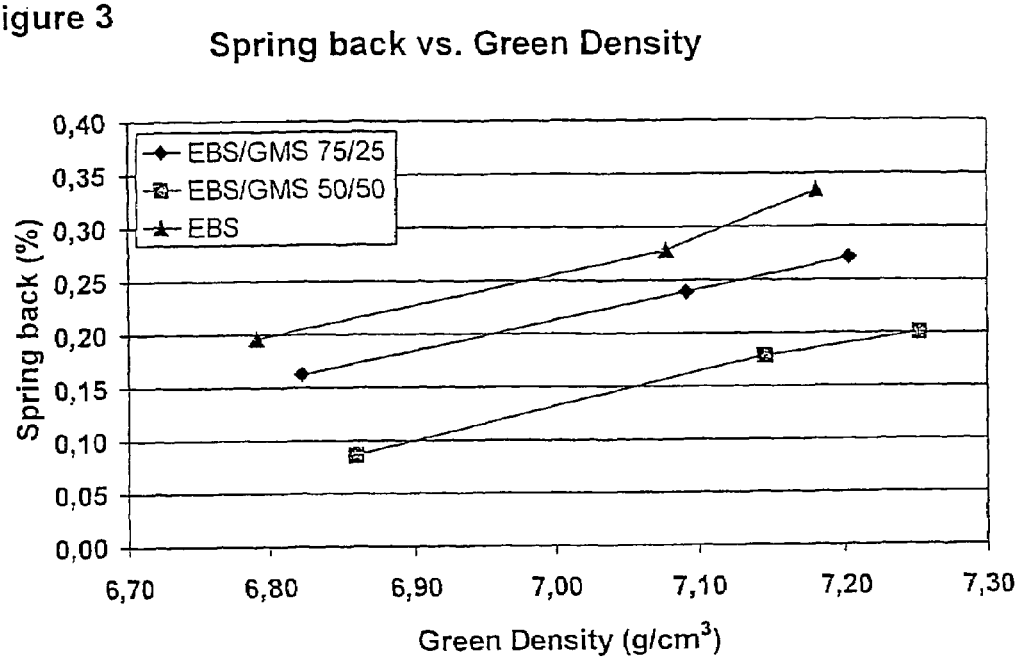
FIG. 3 discloses the spring back as a function of the green density obtained with the inventive powder composition in comparison with the same powder including the conventionally used lubricant EBS.
Figure 4:
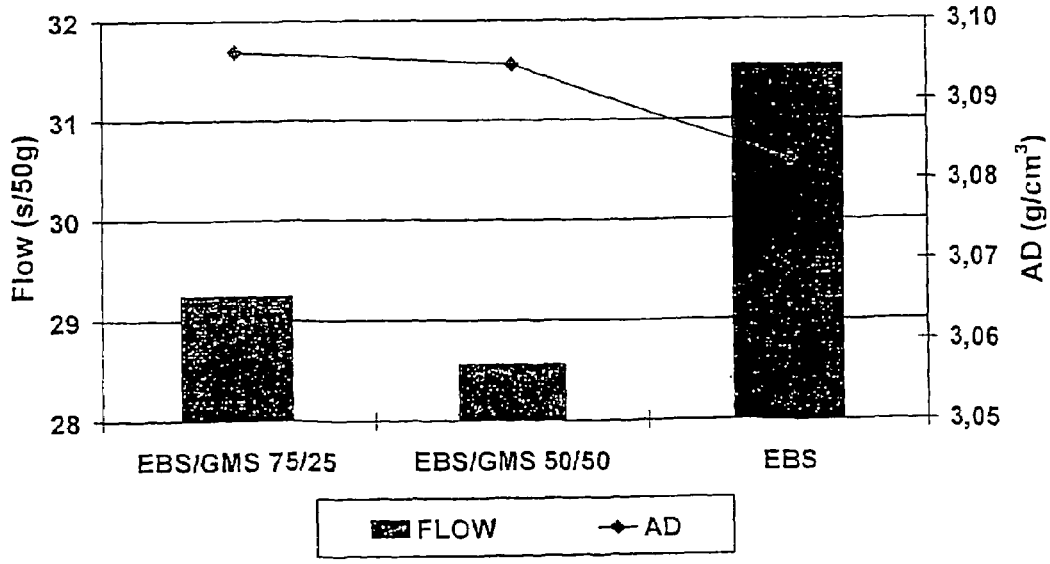
FIG. 4 discloses the flow and apparent density of the inventive powder composition in comparison with the same powder including the conventionally used lubricant EBS.

The different test mixtures were tested as regards green density (GD), sintered density (SD), ejection energy and flow and the results are shown in FIGS. 1-4,

EXAMPLE 2

This example illustrates further advantages with the present invention. In this example EBS/GMS in different ratios were used as a binder/lubricant according to U.S. Pat. No. 5,480,469 (Storstrom, et al.)

The binder/lubricant mixtures listed in table 2 below were prepared, and the content of EBS and GMS expressed as % of the lubricant composition;

TABLE 2

| Sample | EBS | GMS |
|---|---|---|
| 4 | 100 | 0 |
| 5 | 90 | 10 |
| 6 | 75 | 25 |
| 7 | 50 | 50 |

Four different metal powder composition were prepared by homogenously mixing ASC 100.29 with 2% of copper powder, 0.5% of graphite and 0.6% of a lubricant/binder composition according to table 2. The compositions were heated to 150° C. during mixing and melting of the binder/lubricant and subsequently cooled until the binder/lubricant had solidified.

Samples from the four metal powder compositions were produced by a uniaxial pressing operation at 600 MPa and spring back (SB), green densaity (GD) and green strength were measured. From the following table 3 it can be concluded that a major improvement of the green strength, as well as in green density and spring back, have been obtained for the samples containing a binder/lubricant composition of a mixture of EBS/GMS compared to the samples containing EBS as a sole binder/lubricant.

TABLE 3

| Sample | 4 | 5 | 6 | 7 |
|---|---|---|---|---|
| GS (MPa) | 11.7 | 12.9 | 14.6 | 16.6 |
| GD (g/cm3) | 7.12 | 7.14 | 7.16 | 7.18 |
| SB (%) | 0.31 | 0.29 | 0.27 | 0.25 |

The invention claimed is:

1. A metal powder composition including a metal base powder, one or more pulverulent additives, wherein the particles of at least one of the additives are bonded to the metal base powder particles by an at least partially molten, solidified mixture consisting of 5-95% by weight of glyceryl stearate and 95-5% by weight of at least one non-metallic fatty acid compound serving as a binder/lubricant.

2. The powder composition according to claim 1, wherein the metal base powder is an essentially pure iron powder, a pre-alloyed iron powder or a diffusion alloyed iron powder.

3. The powder composition according to claim 1, wherein the additives are selected from the group consisting of copper, molybdenum, chromium, manganese, nickel, phosphorus and carbon in the form of graphite.

4. The powder composition according to claim 1, wherein the non-metallic fatty acid compound is selected from the group consisting of ethylene bisstearamide, stearic acid, oleic acid, oleyl amide, stearamide and ethylene bisoleylamide.

5. The powder composition according to claim 1, wherein the mixture consists of 60-85% by weight of ethylene bisstearamide and 15-40% by weight of glyceryl stearate.

6. The powder composition according to claim 1, wherein the metal powder also includes one or more additives selected from the group consisting of binders, processing aids, hard phases and flow enhancing agents.

7. The powder composition according to claim 5, wherein the mixture is present as a molten and subsequently solidified and micronised powder of glyceryl stearate and ethylene bisstearamide.

8. The metal powder composition including a metal base powder, optionally one or more pulverulent additives and 0.1-2.0% by weight of a pulverulent mixture consisting of 5-95% by weight of the glyceryl stearate and 95-5% by weight of at least one non-metallic fatty acid compound serving as a binder/lubricant.

9. The powder composition according to claim 8, wherein the mixture is present as a molten and subsequently solidified and micronised powder of glyceryl stearate and ethylene bisstearamide.

10. The powder composition according to claim 8, wherein the metal base powder is an essentially pure iron powder, a pre-alloyed iron powder or a diffusion alloyed iron powder.

11. The powder composition according to claim 8, wherein the additives are selected from the group consisting of copper, molybdenum, chromium, manganese, nickel, phosphorus and carbon in the form of graphite.

12. The powder composition according to claim 8, wherein the non-metallic fatty acid compound is selected from the group consisting of ethylene bisstearamide, stearic acid, oleic acid, oleyl amide, stearamide and ethylene bisoleylamide.

13. The powder composition according to claim 8, wherein the mixture consists of 60-85% by weight of ethylene bisstearamide and 15-40% by weight of glyceryl stearate.

14. The powder composition according to claim 8, wherein the metal powder also includes one or more additives selected from the group consisting of binders, processing aids, hard phases and flow enhancing agents.

15. The powder composition according to claim 2, wherein the additives are selected from the group consisting of copper, molybdenum, chromium, manganese, nickel, phosphorus and carbon in the form of graphite.

16. The powder composition according to claim 10, wherein the additives are selected from the group consisting of copper, molybdenum, chromium, manganese, nickel, phosphorus and carbon in the form of graphite.

17. The powder composition according to claim 2, wherein the mixture is present as a molten and subsequently solidified and micronised powder of glyceryl stearate and ethylene bisstearamide.

* * * * *